US006392626B1

(12) United States Patent
Moon

(10) Patent No.: US 6,392,626 B1
(45) Date of Patent: May 21, 2002

(54) LIQUID CRYSTAL DISPLAY HAVING DIFFERENT COMMON VOLTAGES

(75) Inventor: Seung-Hwan Moon, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/433,930

(22) Filed: Oct. 26, 1999

(30) Foreign Application Priority Data

Nov. 6, 1998 (KR) ..... 98-47454

(51) Int. Cl.[7] ..... G09G 3/36
(52) U.S. Cl. ..... 345/94; 345/92
(58) Field of Search ..... 345/94, 87–89, 345/90, 204, 211, 92, 98, 100, 58

(56) References Cited

U.S. PATENT DOCUMENTS 5,706,023 A * 1/1998 Nagata et al. ..... 345/92
5,774,099 A * 6/1998 Iwasaki ..... 345/87
5,818,402 A * 10/1998 Park et al. ..... 345/58
5,995,074 A * 11/1999 Kusafuka et al. ..... 345/90
6,222,516 B1 * 4/2001 Oda et al. ..... 345/94
6,229,510 B1 * 5/2001 Kim et al. ..... 345/87

OTHER PUBLICATIONS

Ghausi, Mohammed S. "Electronic Devices and Circuits" CBS College Publishing, pp. 33–35, 1985.*

* cited by examiner

*Primary Examiner*—Richard Hjerpe
*Assistant Examiner*—Francis Nguyen
(74) *Attorney, Agent, or Firm*—McGuireWoods LLP

(57) ABSTRACT

Disclosed is a liquid crystal display that prevents a flicker by employing a circuit with adjustable resistors in the output of a common voltage generator. The common voltage generator supplies two distinct common voltages, one common voltage being supplied to a common electrode at a point that is physically close to the output of a gate driver, and a second common voltage being supplied to a point that is physically further from the output of the gate driver than the point where the first voltage is applied. These points where the first common voltage and the second common voltages are applied are electrically coupled via an internal panel resistor. A flicker is prevented by adjusting the variable resistors so that the difference between the first and second common voltages is equal to the difference in the kickback voltages at the first point and at the second point.

9 Claims, 4 Drawing Sheets

LIQUID CRYSTAL DISPLAY HAVING DIFFERENT COMMON VOLTAGES

BACKGROUND OF THE INVENTION (a) Field of the Invention

The present invention relates to a liquid crystal display (LCD). More specifically, the present invention relates to a thin film transistor liquid crystal display (TFT LCD).

(b) Description of the Related Art

In a TFT LCD, an electric field is supplied to liquid crystal material having an anisotropic transmittivity injected between two panels, and the amount of the light penetrating the panels is adjusted by controlling the strength of the electric field to obtain desired pixel signals.

In the TFT LCD panel, a plurality of gate lines lie in parallel, and a plurality of insulated data lines lie across the gate lines. The square area made by the gate line and the data line forms a pixel. A TFT is formed at a point where a gate line of each pixel crosses a data line of a pixel.

FIG. 1 shows an equivalent circuit for a pixel in a conventional TFT LCD. As shown, a gate electrode g, a source electrode s, and a drain electrode d of the TFT 10 are coupled to a gate line Gn, a data line Dm, and a pixel electrode P, respectively. Liquid crystal material injected between the pixel electrode P and common electrode Com is equivalently indicated as a crystal capacitance Clc. A storage capacitance Cst is made between the pixel electrode P and a gate line Gn−1. A parasitic capacitance Cgd caused by misalignment is made between the gate electrode g and drain electrode d. The liquid crystal capacitance Clc and the storage capacitance Cst function as a load on the TFT LCD.

The operations of the TFT LCD will now be described.

When a gate ON voltage Von is supplied to the gate electrode g which is coupled to the gate line Gn so as to drive the TFT 10, a data voltage indicating a pixel signal is supplied to the source electrode s, and the data voltage is then supplied to the drain electrode d. From the drain electrode d, the data voltage is supplied to both the liquid crystal capacitance Clc and the storage capacitance Cst through the pixel electrode P. An electric field is generated by the voltage difference between the pixel electrode P and the common electrode Com. If an electric field continues to be applied to the liquid crystal material in one direction, the liquid crystal material may deteriorate. Therefore, in order to avoid this problem, the pixel signals are switched from a positive value to a negative value with respect to a common voltage. This technique is referred to as an inversion drive method.

The voltage supplied to the crystal capacitance Clc and the storage capacitance Cst when the TFT is turned on is supposed to be kept constant after the TFT is turned off. However, due to the parasitic capacitance Cgd between the gate electrode and the drain electrode, the voltage supplied to the pixel electrode is distorted. The distorted voltage is called a kickback voltage ΔV, which is described by Equation 1.

Equation 1:

$$\Delta V = \frac{Cgd}{Cgd + Cst + Clc} \cdot \Delta Vg = \frac{Cgd}{Cgd + Cst + Clc} \cdot (Von - Voff)$$

where ΔVg is a variance of the gate voltage, that is, a difference between the gate ON voltage Von and gate OFF voltage Voff.

The voltage distortion always tends to reduce the voltage of the pixel electrode regardless of the polarity of the data voltage, as shown in FIG. 2.

Referring to FIG. 2, Vg, Vd, and Vp indicates the gate voltage, data voltage, and pixel electrode voltage. Vcom and ΔV indicates a common electrode voltage (common voltage) and kickback voltage, respectively.

In an ideal TFT LCD as shown by a dotted Vd line in FIG. 2, when the gate voltage Vg is turned on, the data voltage Vd is applied to the pixel polarity, and thereby, when the gate voltage is turned off, the applied data voltage should be maintained. But in an actual TFT LCD as shown by a solid Vp line in FIG. 2, when the gate voltage falls, the pixel voltage Vp is reduced by the kickback voltage ΔV.

An actual value of the voltage supplied to the liquid crystal is obtained from the area between the pixel voltage Vp and common voltage Vcom lines in FIG. 2. When an LCD is driven by an inversion drive method, the level of the common voltage must be adjusted to keep the above-noted area equal during the period of the gate voltage switching. Therefore, a common voltage satisfying the above-mentioned condition needs to be supplied to the common electrode.

However, as the shapes of these above-noted areas in each half of the gate voltage switching cycle (or frame) are not identical, the amount of the pixel voltage supplied to each pixel becomes different for each frame, which causes a flicker whenever the pixel voltage is inverted.

Even when a constant common voltage that can make the above-noted areas equal is supplied to the common electrode in order to suppress the flicker phenomena, the flicker phenomena still may continue.

Generally, the gate lines have both resistance and parasitic capacitance. Accordingly, the gate voltage is hence delayed by a time constant determined by the product of resistance and parasitic capacitance. As the size of the LCD panel becomes bigger, the signal delay becomes longer.

FIG. 3 shows a sketch of a measured value of the gate voltage Vg which is delayed due to the length of the gate line. Vg1 represents the gate voltage measured on the gate line near the gate voltage input terminal (or the gate driver output terminal), and Vg2 represents the gate voltage measured on the gate line far from the gate voltage input terminal.

Hence, the further from the gate voltage input terminal, (i.e., the more the gate signal is delayed), the more the variance of the gate voltage (ΔVg in Equation 1, which represents the difference between the gate ON voltage Von and gate OFF voltage Voff) becomes smaller, and thereby the kickback voltage ΔV decreases as shown by Equation 1.

Therefore, even when a constant common voltage is used, this voltage cannot maintain the mid-voltage value for all the pixels. Accordingly, pixel voltages may still vary from frame to frame and the flicker phenomenon will still continue. As LCD screens become larger and therefore the gate lines become longer, it happens more frequently.

SUMMARY OF THE INVENTION

It is an object of the present invention to provide an apparatus for preventing flickers caused by signal delays of the gate voltage.

In order to achieve this objective, the present invention provides a liquid crystal display that comprises a first panel including a plurality of thin film transistors, a plurality of gate lines, a plurality of insulated data lines crossing the gate lines and a plurality of pixel electrodes. The liquid crystal display device also comprises a second panel having a common electrode facing the pixel electrode, a gate driver that turns on and off the thin film transistors, a data driver that supplies a data voltage to the data lines, and a common voltage generator that supplies a first common voltage and a second common voltage. The second common voltage is higher than the first common voltage, and the voltage difference between the first common voltage and second the common voltage is adjusted. The common voltage generator comprises a voltage supply, a first resistor and a second resistor. The first resistor or the second resistor may be a variable resistor.

The voltage difference between the first common voltage and the second common voltage is equal to the voltage difference between a pixel electrode kickback voltage at the first point and a pixel electrode kickback voltage at the second point.

The present invention adjusts the voltage difference of the common voltage generator by adjusting the value of a variable resistor, and prevents a flicker.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

In the following detailed description, only the preferred embodiment of the invention has been shown and described, simply by way of illustrating the best mode contemplated by the inventor(s) of carrying out the invention. As will be realized, the invention is capable of modification in various obvious respects, all without departing from the invention. Accordingly, the drawings and description are to be regarded as illustrative in nature, and not restrictive.

Figure 4:
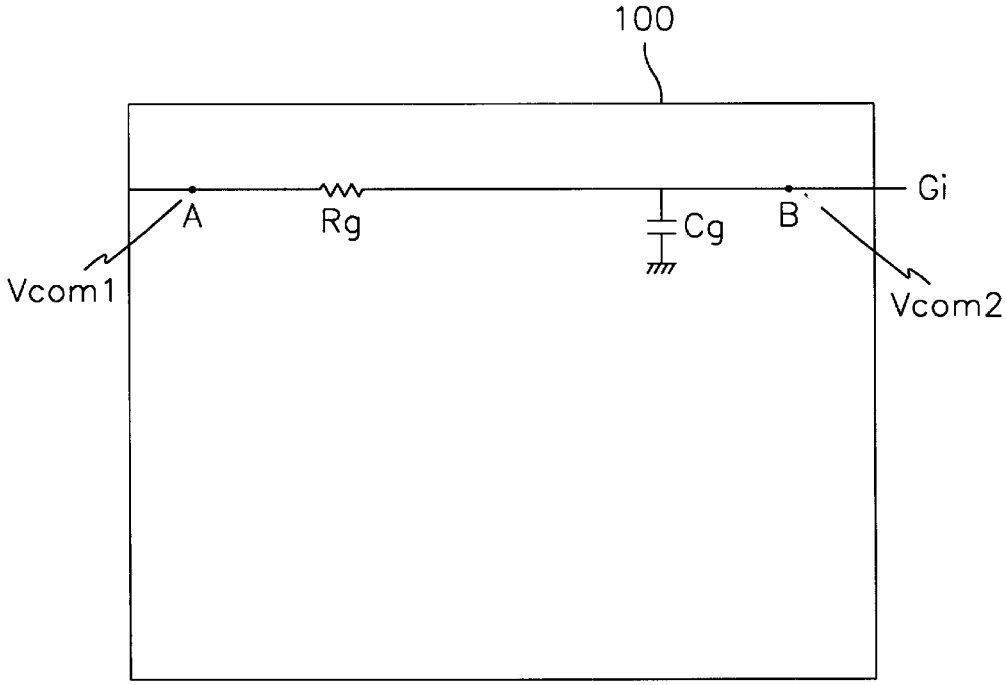
FIG. 4 is a simple schematic sketch according to the present invention.

FIG. 4 shows a simple schematic sketch of the present invention.

Referring to FIG. 4, point A is close to a gate driver (not illustrated) that induces a gate voltage, and point B is further from the gate driver.

Different common voltages Vcom(0) and Vcom(L) are supplied at both A end and B end of the gate line. The kickback voltage at point B is lower than the kickback voltage at point A because the signal is delayed by the long gate lines, causing the conventional flicker phenomenon. Therefore, in order to prevent a flicker, the common voltage Vcom(L) supplied to point B on a panel 100 needs to be set higher than the common voltage Vcom(0) supplied to point A.

In detail, when the kickback voltage at point A close to the gate driver is defined as ΔV(0), and the kickback voltage distant from the gate driver is defined as ΔV(L), then these kickback voltages are expressed as follows.

Equation 2:

$$\Delta V(0) = \frac{Cgd}{Cgd + Cst + Clc} \cdot [Von(0) - Voff]$$

$$\Delta V(L) = \frac{Cgd}{Cgd + Cst + Clc} \cdot [Von(L) - Voff],$$

where Von(0) and Von(L) represents the gate ON voltage at point A and point B, respectively, and Cgd, Cst, and Clc represent a parasitic capacitance, a storage capacitance, and a liquid crystal capacitance, respectively.

Figure 1:
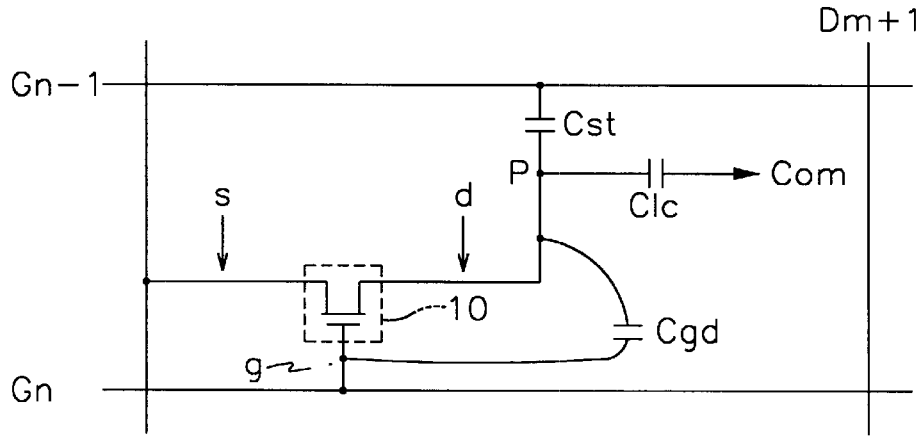
FIG.1 (Prior Art)
FIG. 1 is an equivalent circuit to a unit pixel of a conventional TFT LCD.
Figure 2:
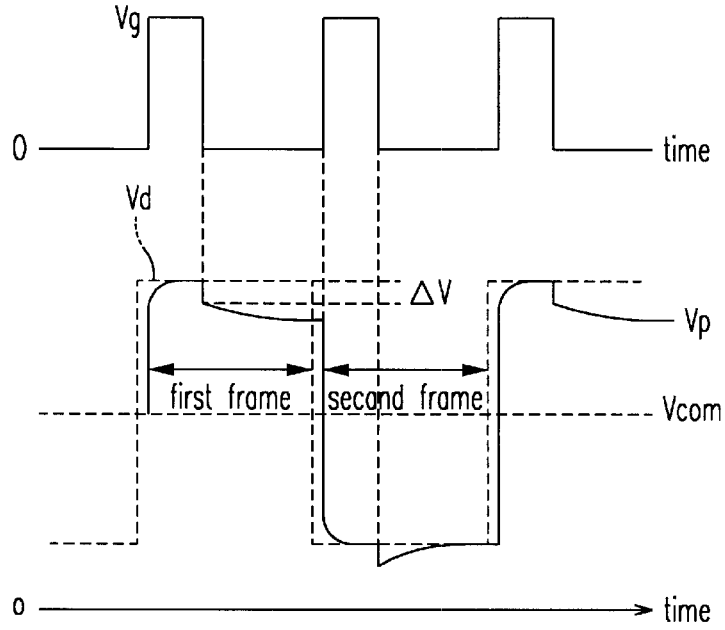
FIG.2 (Prior Art)
FIG. 2 is a graph that illustrates voltage distortion caused by kickback voltages.
Figure 3:
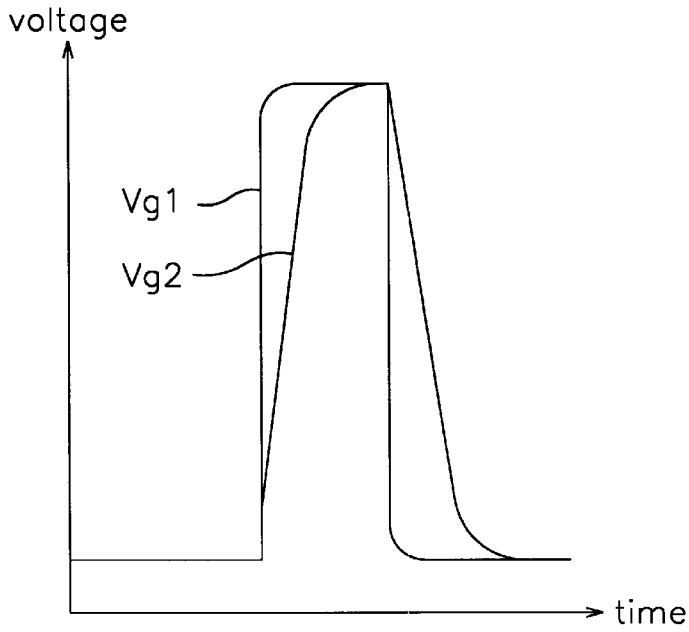
FIG.3 (Prior Art)
FIG. 3 is a sketch for illustrating measured gate voltage differences due to signal delays of the gate lines.

Referring to FIG. 2, since Von(0) is greater than Von(L) due to the signal delays of the gate line, ΔV(0) becomes greater than ΔV(L). That is, the further located from the gate driver, the kickback voltage becomes smaller. Accordingly, the further from the gate driver output, the reduced kickback voltage pulls down the pixel voltage less.

Hence, when the common voltage Vcom(L) at point B is set higher than the common voltage Vcom(0) at point A, the flicker phenomena due to gate delay can be fixed. In this case, an equation between the kickback voltage and common voltage to remove flicker due to the gate delay is $$Vcom(L)=Vcom(0)+[\Delta V(0)-\Delta V(L)]. \quad \text{Equation 3:}$$

As shown by Equation 3, when the common voltage difference Vcom(L)−Vcom(0) between point A and point B is set to be equal to the kickback voltage difference ΔV(0)−ΔV(L), the flicker phenomena due to the signal delays of the gate lines can be prevented.

Figure 5:
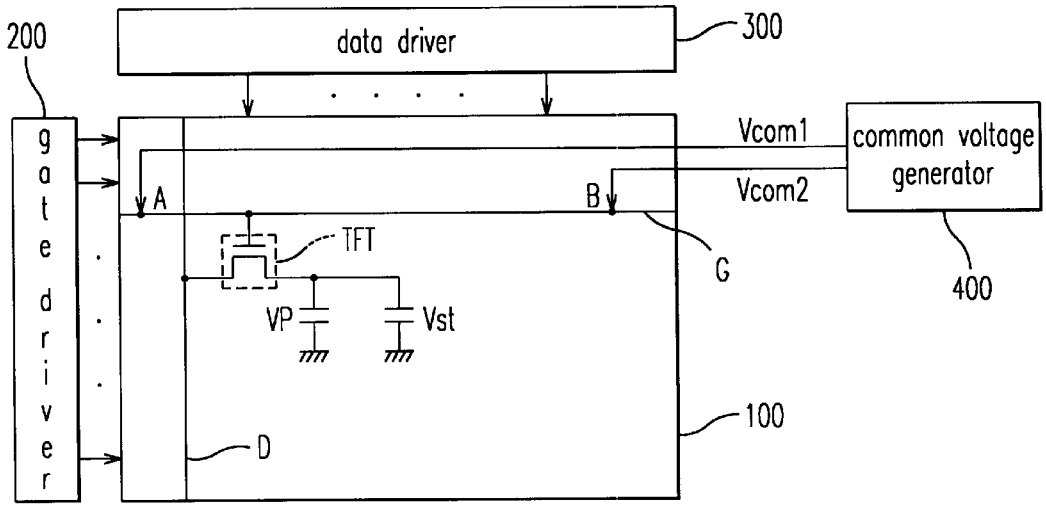
FIG. 5 is a simple schematic view of a TFT LCD device according to a preferred embodiment of the present invention.

FIG. 5 shows a schematic view of a TFT LCD according to a preferred embodiment of the present invention.

As shown, the TTL LCD comprises a TFT LCD panel 100, a gate driver 200, a data driver 300, and a common voltage generator 400.

The data driver 300 supplies a data voltage for image signals to each data line D of the TFT LCD panel. The gate driver 200 outputs a gate voltage to turn on the TFT of each pixel, so that the data voltage supplied to each data line D may be supplied to a pixel electrode.

A representative data line D supplying the data voltage from the data driver 300 crosses a representative gate line G supplying the gate voltage from the gate driver 200 on the TFT LCD panel 100. The source electrode and the gate electrode of the TFT in each pixel are coupled to the data line and the gate line. Referring to FIG. 5, an equivalent circuit for a pixel on the TFT LCD panel 100 is illustrated for ease of explanation, and Vp indicates a voltage charged on a pixel electrode, and Vst indicates a voltage charged into a storage capacitance electrode.

The common voltage generator 400 supplies different common voltages Vcom1 and Vcom2 to point A and point B of the gate line. Vcom2 is higher than Vcom1, which satisfies the above-noted Equation 3.

Figure 6:
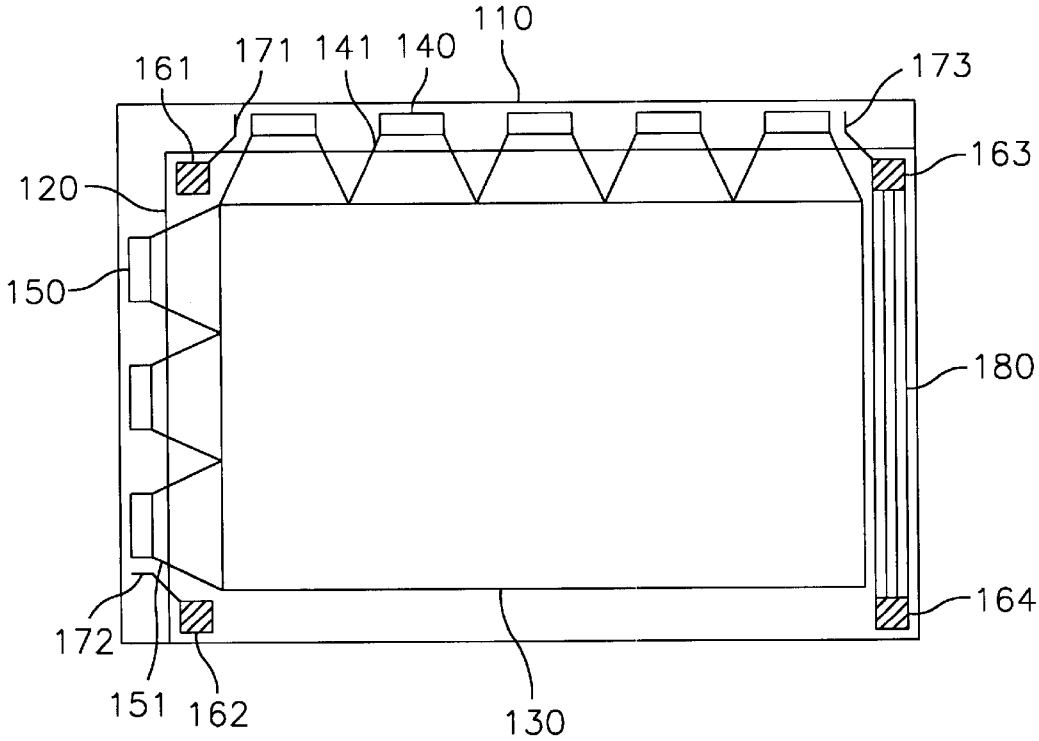
FIG. 6 illustrates a panel structure of the TFT LCD device according to a preferred embodiment of the present invention.

FIG. 6 shows a panel structure of a TFT LCD panel according to a preferred embodiment of the present invention.

As shown, the TFT LCD panel comprises a first panel 110 and a second panel 120 that faces the first panel 110. Conventionally, thin film transistors and pixel electrodes are formed on the first panel 110, which is also called a TFT (thin film transistor) panel. The color filter and common electrodes are configured on the second panel 120, which is also called a CF (color filter) panel.

The two panels 110 and 120 have a display area 130 that display images and comprises a plurality of pixels. The upper side of the first panel 110 is coupled to a plurality of data lines (not illustrated). A plurality of data pads 140 are positioned on the upper side of the first panel to transfer the external data voltage. The left side of the first panel 110 in FIG. 6 is coupled to a plurality of gate lines (not illustrated). A plurality of gate pads 150 are positioned on the left side of the first panel to transfer the external gate voltage. Connection units 141 and 151 that connect the gate lines and data lines with the respective pads 140 and 150 are located between the display area 130 and pads 140 and 150.

Four common electrode connection points 161, 162, 163, and 164 are at the four corners outside the display area 130. The connection points 161, 162, 163, and 164 receive the external common voltage through dummy pads 171,172, and 173 (i.e., extra pads locating beside the 140 and 150 pads). Two connection points 163 and 164 at the right sides of the two panels 110 and 120 in FIG. 6 are coupled to a common connection line 180. The common connection line 180 is made by wiring a plurality of low resistance metal films, so as to minimize the voltage dropping caused by the resistance of the conductor between the two connection points 163 and 164.

Different common voltages Vcom1 and Vcom2 are respectively supplied to the common electrode connection points (161 and 162), and (163 and 164) to prevent the flicker phenomena caused by the signal delays in the gate line.

Figure 7:
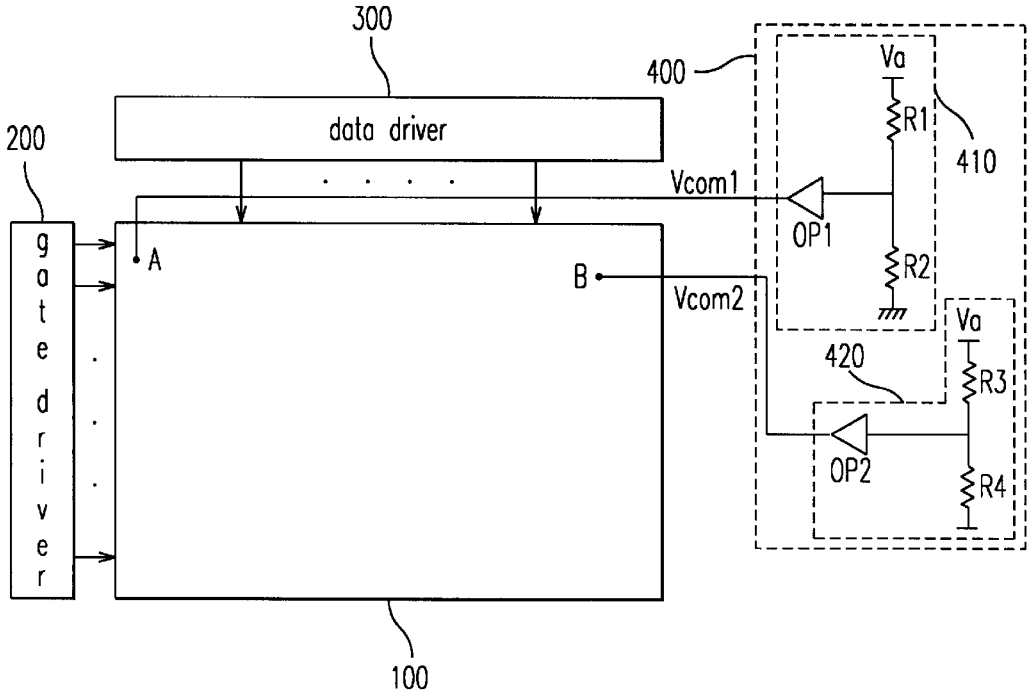
FIG. 7 is a schematic drawing of a common voltage generator according to a preferred embodiment of the present invention.

Referring to FIG. 7, the common voltage generator 400 according to a preferred embodiment of the present invention will now be described.

As shown by FIG. 7, the common voltage generator 400 comprises a first common voltage generator 410 and a second common voltage generator 420. The first and second common voltage generators 410 and 420 that respectively generate the common voltages Vcom1 and Vcom2 comprise a supply voltage Va, resistors R1, R2, R3, and R4, and amplifiers OP1 and OP2.

In the first common voltage generator 410, the voltage Va is divided by resistor R1 and register R2. The divided voltage is amplified through the amplifier OP1 to generate the common voltage Vcom1. Similarly, in the second common voltage generator 420, the voltage Va is divided by resistor R3 and register R4. The divided voltage is amplified through the amplifier OP2 to generate the common voltage Vcom2.

In this embodiment, the common voltages Vcom1 and Vcom2 satisfy Equation 3. Equation 3 is satisfied by selecting proper values of the resistor R1, R2, R3, and R4 or selecting proper gain values of the amplifiers OP1 and OP2 when manufacturing TFT LCD panels.

However, the variance of delays in the gate lines caused by the panel variation makes it difficult to implement the embodiment of the present invention shown in FIG. 7.

For example, provided that the kickback voltage at point B of a particular panel X that has a relatively less gate line delay be V(L), and that the kickback voltage at point B of a panel Y that has a relatively more gate line delay be V(L)', then V(L) of panel X becomes greater than V(L)' of panel Y.

In such a case, as shown by Equation 3, the common voltage difference Vcom(L)−Vcom(0) supplied to the points A and B on panel X must be different from the common voltage difference Vcom(L)'−Vcom(0)' supplied to the points A and B on panel Y.

Therefore, in order to handle the individual gate line's delay characteristics of each TFT-LCD panel, the common voltage difference supplied to each end of the gate line should be adjusted to prevent a flicker.

However, in the first embodiment of the present invention, since the resistance value and gain value of the amplifier are fixed when manufacturing the TFT LCDs, a flicker generated by the individual gate line's delay characteristics cannot be fixed.

Figure 8:
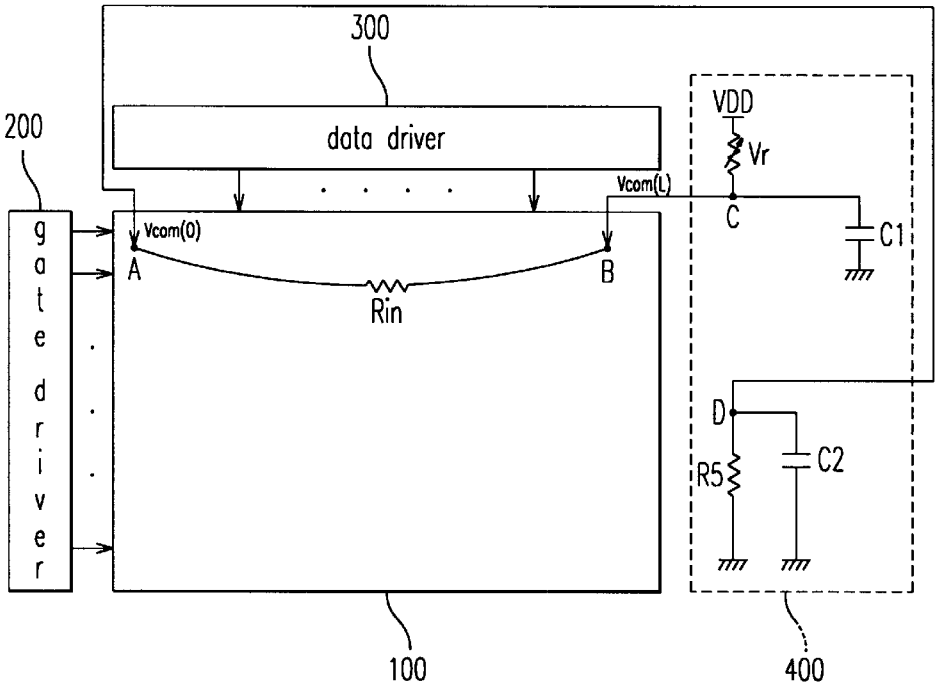
FIG. 8 is a schematic drawing of a common voltage generator according to another preferred embodiment of the present invention.

In order to solve this problem, a schematic diagram of a common voltage generator 400 according to another embodiment of the present invention is shown in FIG. 8.

As shown, the common voltage generator 400 comprises a supply voltage $V_{DD}$, a variable resistor Vr, a resistor R5, and capacitors C1 and C2.

One end of the variable resistor Vr is coupled to the supply voltage $V_{DD}$, and the other end is coupled to one end of the capacitor C1. A voltage between the variable resistor Vr and capacitor C1, that is, a common voltage Vcom(L) is supplied to B on the TFT LCD panel 100. Point C at which the variable resistor Vr meets a capacitor C1 is electrically coupled to point D at which a resistor R5 meets a capacitor C2 through an internal resistor Rin in the TFT LCD panel.

In the embodiment of FIG. 8, common voltages supplied to A and B on the TFT LCD panel can be calculated from the following Equation 4:

$$Vcom(0) = \frac{R5}{R5 + Rin + Vr} \cdot V_{DD} \quad \text{and}$$

Equation 5:

$$Vcom(L) = \frac{R5 + Rin}{R5 + Rin + Vr} \cdot V_{DD}.$$

From Equation 4 and Equation 5, the common voltage difference supplied to point A and point B of the panel is obtained from the following $$Vcom(L) - Vcom(0) = \frac{Rin}{R5 + Rin + Vr} \cdot V_{DD}$$

Accordingly, the voltage difference between ends of the panel can be adjusted using the variable resistor Vr. Therefore, the flicker generated by the individual panel gate line delay characteristics variations can be prevented by adjusting the resistance of the variable resistor.

Capacitors C1 and C2 in FIG. 8 are used to remove ripples generated at the ends of the common electrode. These ripples are generated when the electric charges that are necessary for a liquid crystal capacitor coupled to the common electrode move. In order to minimize the ripples, the capacitance of the capacitors C1 and C2 must be equal to or greater than the capacitance of the liquid crystal capacitor corresponding to a gate line.

Therefore, according to the present invention, the flicker phenomena caused by the signal delay of the gate voltage due to the variation of individual panel gate line delay characteristics can be prevented by supplying different common voltage levels to the different ends of the gate line.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A liquid crystal display device, comprising:

a first panel having a plurality of thin film transistors, with a gate electrode, a source electrode and a drain electrode, a plurality of gate lines, a plurality of data lines crossing the gate lines and a plurality of pixel electrodes, a plurality of thin film transistors (TFTs) each being coupled to the respective pixel electrode, the respective gate line and the respective data line;

a second panel having a common electrode facing the pixel electrode;

a gate driver supplying gate signals to turn on or off the thin film transistors;

a data driver supplying a data voltage to the data line for displaying images; and a common voltage generator that supplies a first common voltage to a first point on the common electrode, and supplies a second common voltage to a second point on the common electrode, the second common voltage being higher than the first common voltage, wherein the common voltage generator comprises:

a voltage supply;

a first resistor of which one end is coupled to the voltage supply and the other end is coupled to the second point; and a second resistor in which one end is coupled to ground and the other end is coupled to the first point, and wherein the first resistor or the second resistor is a variable resistor, and the first point is electrically coupled to the second point through an internal resistor in the second panel.

2. The liquid crystal display device of claim 1, wherein the voltage difference between the first common voltage and the second common voltage is adjusted depending on the gate line characteristics.

3. The liquid crystal display device of claim 2, further comprising:

a first capacitor of which one end is coupled to the second point and the other end is coupled to ground; and a second capacitor of which one end is coupled to the first point and the other is coupled to ground.

4. The liquid crystal display device of claim 3, wherein the voltage difference between the first common voltage and the second common voltage is equal to the voltage difference between a pixel electrode kickback voltage at the first point and a pixel electrode kickback voltage at the second point.

5. The liquid crystal display device of claim 2 wherein the voltage difference between the first common voltage and the second common voltage is equal to the voltage difference between pixel electrode kickback voltage at the first point and a pixel electrode kickback voltage at the second point.

6. The liquid crystal display device of claim 1, wherein the common voltage generator comprises:

a first common voltage generator that supplies the first common voltage to the first point on the common electrode; and a second common voltage generator that supplies the second common voltage to the second point on the common electrode.

7. The liquid crystal display device of claim 6, wherein the first common voltage generator comprises:

a voltage supply;

a first amplifier of which output is coupled to the first point of the common electrode;

a first resistor of which one end is coupled to the voltage supply and the other end is coupled to the amplifier; and a second resistor of which one end is coupled to the amplifier and the other end is grounded, and wherein the second common voltage generator comprises:

a voltage supply;

a second amplifier of which output is coupled to the second point of the common electrode;

a third resistor of which one end is coupled to the voltage supply and the other end is coupled to the amplifier; and a fourth resistor of which one end is coupled to the amplifier and the other end is grounded.

8. The liquid crystal display device of claim 7, wherein the first common voltage generator supplies the first common voltage to the first point on the common electrode by dividing the voltage coming from the voltage supply by the first resistor and the second resistor and amplifying the divided voltage through the first amplifier, and wherein the second common voltage generator supplies the second common voltage to the second point on the common electrode by dividing the voltage coming from the voltage supply by the third resistor and the fourth resistor and amplifying the divided voltage through the second amplifier.

9. The liquid crystal display device of claim 8, wherein the voltage difference between the first common voltage and the second common voltage is equal to the voltage difference between a pixel electrode kickback voltage at the first point and a pixel electrode kickback voltage at the second point.

* * * * *